US007406945B2

(12) United States Patent
Augustin

(10) Patent No.: US 7,406,945 B2
(45) Date of Patent: Aug. 5, 2008

(54) COMMON RAIL SYSTEM WITH PRESSURE AMPLIFICATION

(75) Inventor: Ulrich Augustin, Blythewood, SC (US)

(73) Assignee: Continental Automotive Systems US, Inc., Auburn Hills ( * ) Notice: Subject to any disclaimer, the term of this patent is extended or adjusted under 35 U.S.C. 154(b) by 257 days.

(21) Appl. No.: 11/358,596

(22) Filed: Feb. 21, 2006

(65) Prior Publication Data

US 2006/0222514 A1 Oct. 5, 2006

Related U.S. Application Data

(60) Provisional application No. 60/655,302, filed on Feb. 22, 2005.

(51) Int. Cl.
*F02M 59/46* (2006.01)
*F02M 41/16* (2006.01)

(52) U.S. Cl. ..... 123/467; 239/96

(58) Field of Classification Search ..... 123/446, 123/447, 510, 511; 239/88–96
See application file for complete search history.

(56) References Cited

U.S. PATENT DOCUMENTS 4,219,154 A * 8/1980 Luscomb ..... 239/91
4,426,977 A * 1/1984 Taplin et al. ..... 123/446
4,628,881 A * 12/1986 Beck et al. ..... 123/447
5,143,291 A * 9/1992 Grinsteiner ..... 239/88
5,241,935 A * 9/1993 Beck et al. ..... 123/300
5,445,129 A * 8/1995 Barnes ..... 123/446
5,551,391 A * 9/1996 Beck et al. ..... 123/305
5,651,345 A * 7/1997 Miller et al. ..... 123/446
5,682,858 A * 11/1997 Chen et al. ..... 123/467
6,910,462 B2 * 6/2005 Sun et al. ..... 123/445
2005/0235962 A1 10/2005 Fresinger
2006/0049284 A1 3/2006 Magel

FOREIGN PATENT DOCUMENTS

DE 197 38 804 3/1999
DE 199 48 464 4/2001
DE 102 49 840 5/2004
DE 102 60 775 7/2004
DE 103 24 225 12/2004
GB 883 335 11/1961
GB 1 012 460 12/1965

OTHER PUBLICATIONS

International Search Report dated Jun. 27, 2006.

* cited by examiner

*Primary Examiner*—Thomas N Moulis

(57) ABSTRACT

A fuel system includes a fuel rail that communicates fuel at a first pressure through a fuel amplifier to a fuel injector. The fuel pressure amplifier increases the pressure from the first pressure to a second pressure. The second pressure is higher than the first pressure and is communicated through each of the plurality of fuel injectors. The fuel amplifiers provide for the application of fuel pressure without the need to configure each and every fuel system component for the corresponding higher pressures.

18 Claims, 4 Drawing Sheets

COMMON RAIL SYSTEM WITH PRESSURE AMPLIFICATION

REFERENCE TO RELATED APPLICATION

The application claims priority to U.S. Provisional Application No. 60/655,302 filed Feb. 22, 2005.

BACKGROUND OF THE INVENTION

This invention generally relates to a fuel system for an internal combustion engine. More particularly, this invention relates to a fuel rail system for amplifying fuel pressure communicated to a fuel injector.

Common fuel systems provide a desired fuel pressure to various fuel injectors for an engine. An increase in fuel pressure can provide increased efficiencies that provide improved performance and fuel economy. Further, high fuel pressures can provide a desirable reduction in emissions. High fuel pressures also provide significant improvements for diesel fuel engines.

Disadvantageously, the magnitude of fuel pressure is limited by the components such as the fuel rail, high-pressure pump, rail connections, valves, actuators and other complementary devices. Increased fuel pressures require more robust devices rated for the increased pressures that in turn increase cost.

Accordingly, it is desirable to develop and design a fuel system that delivers increased pressures while limiting the need for high-pressure compatible components.

SUMMARY OF THE INVENTION

An example fuel system according to this invention includes a fuel rail supplying fuel to a plurality of fuel injectors and a pressure amplifier disposed between the fuel rail and each of the fuel injectors. The pressure amplifier increases pressure of the fuel that is communicated to each of the plurality of fuel injectors such that the entire fuel system need not be configured to accommodate the increased fuel pressures.

The example fuel system according to this invention includes a fuel rail that receives fuel from a fuel source such as a fuel tank at a first pressure. This first pressure is lower than the desired second pressure that will be injected into the engine. The fuel amplifier utilizes fuel flow generated by opening and closing of the fuel injectors to increase fuel pressure above that pressure that is initially provided from the fuel rail.

Each of the fuel amplifiers includes a pressure intensifier piston that is connected to a valve assembly. The valve assembly opens and closes responsive to the opening and closing of the fuel injector and thereby the flow of fuel. As the valve assembly within the fuel amplifier opens and closes, pressure within an intensifier chamber is increased to provide a desired second pressure that is higher than a first pressure within the fuel rail or fuel source.

Accordingly the fuel system according to this invention provides for increased fuel pressure at each of the fuel injectors without requiring many high pressure rated fuel system components.

These and other features of the present invention can be best understood from the following specification and drawings, the following of which is a brief description.

DETAILED DESCRIPTION OF THE PREFERRED EMBODIMENT

Figure 1:
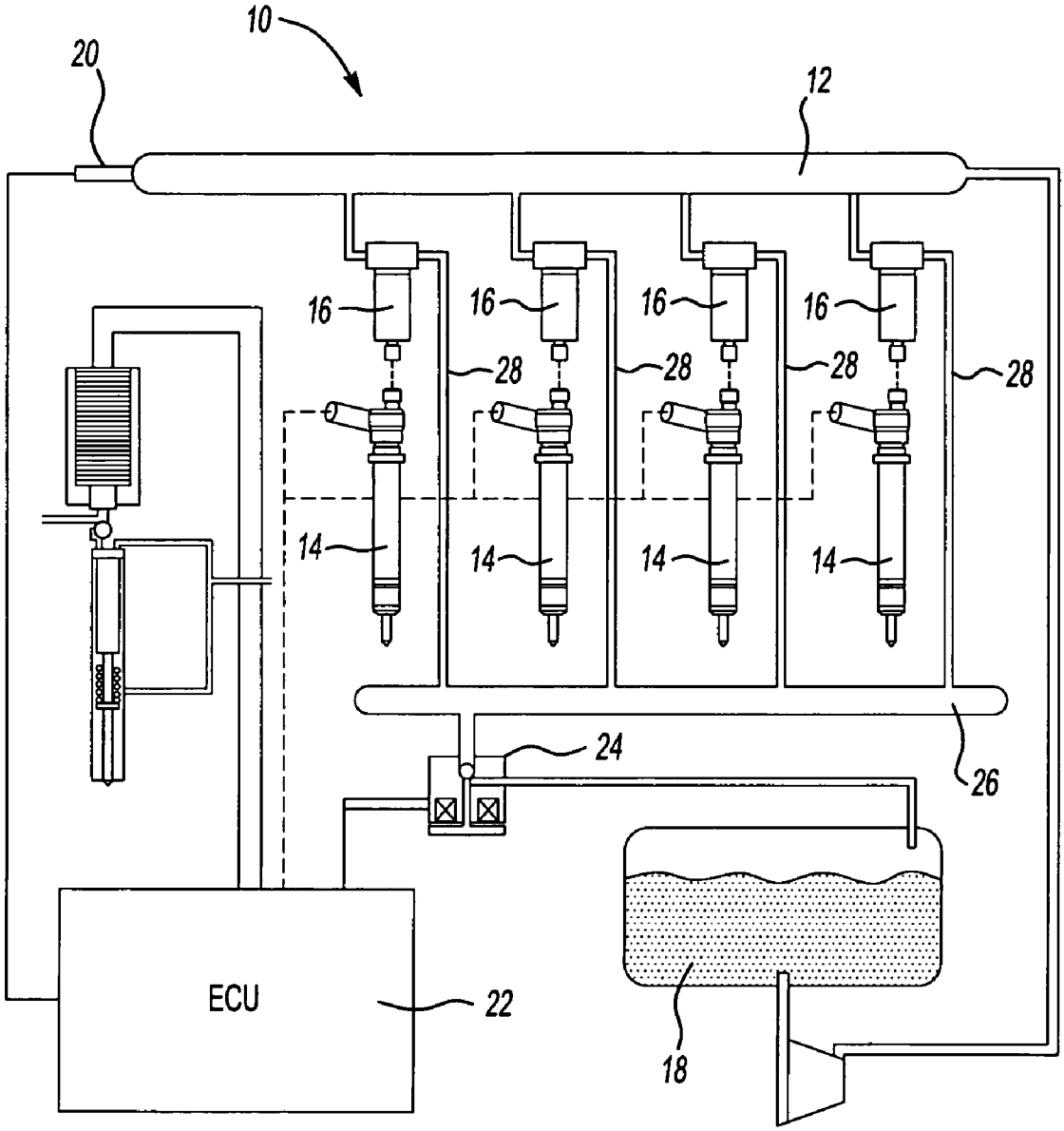
FIG. 1 is a schematic view of an example fuel system according to this invention.

Referring to FIG. 1, a fuel system 10 includes a fuel rail 12 that supplies fuel from a fuel tank 18 to a plurality of fuel injectors 14. Disposed between the fuel rail 12 and each of the fuel injectors 14 is a fuel amplifier 16. The fuel amplifier 16 provides an increase in pressure from a first fuel pressure that is provided by the fuel rail 12 to a desired second fuel pressure that is supplied to each of the plurality of fuel injectors 14. A pressure sensor 20 is disposed within the fuel rail 12 to provide information to a controller 22 that is indicative of fuel pressure within the fuel rail 12. The controller 22 is also in electrical communication with each of the fuel injectors 14 to control actuation during operation of the engine.

Each of the fuel amplifiers 16 include an exhaust line 28 that communicates fuel to a return rail 26 and back to the fuel tank 18. The return rail and fuel tank 18 are both at an ambient pressure. Fuel flow from the return rail 26 and the fuel tank 18 is regulated by a bypass valve 24. Operation of the bypass valve 24 is controlled by the controller 22.

Figure 2:
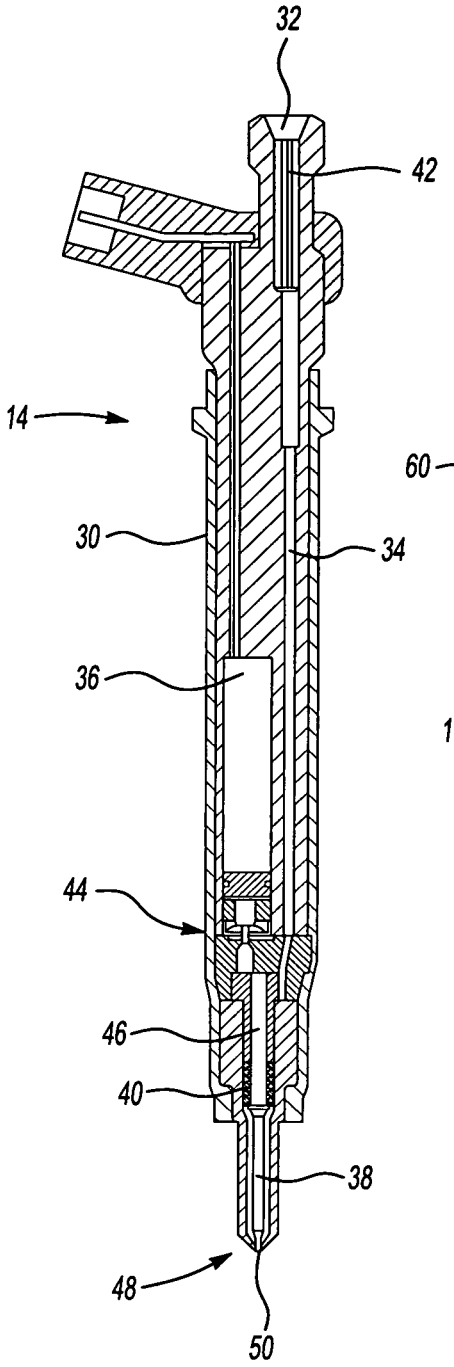
FIG. 2 is a cross-sectional view of an example fuel injector according to this invention.

Referring to FIG. 2, one of the plurality of fuel injectors 14 is illustrated and includes an inlet 32 for incoming fuel and an in-line filter 42. The in-line filter 42 is as known in the art and cleanses incoming fuel to prevent contaminants from entering smaller passages within the fuel injector 14.

The fuel injector 14 includes a body portion 30 that defines a first bore 34 that communicates fuel to fuel passages disposed near a tip portion 48. The fuel injector 14 includes a piezoelectric actuator 36 that controls operation of a two-way valve 44. The two-way valve 44 controls the flow of fuel communicated to a bore including a piston valve 46. The piston valve 46 includes a needle valve 38 that cooperates with an outlet seat 50 to control fuel flow. Selectively positioning the needle valve 38 on the outlet seat 50 provides for the selective control of fuel passing there through. The piston valve 46 is biased toward a closed position by a spring 40. The spring 40 is supported on a spring perch of the needle valve 38. It should be understood that the example fuel injector 14 is only one known configuration that may benefit from the disclosure of this invention.

Figure 3:
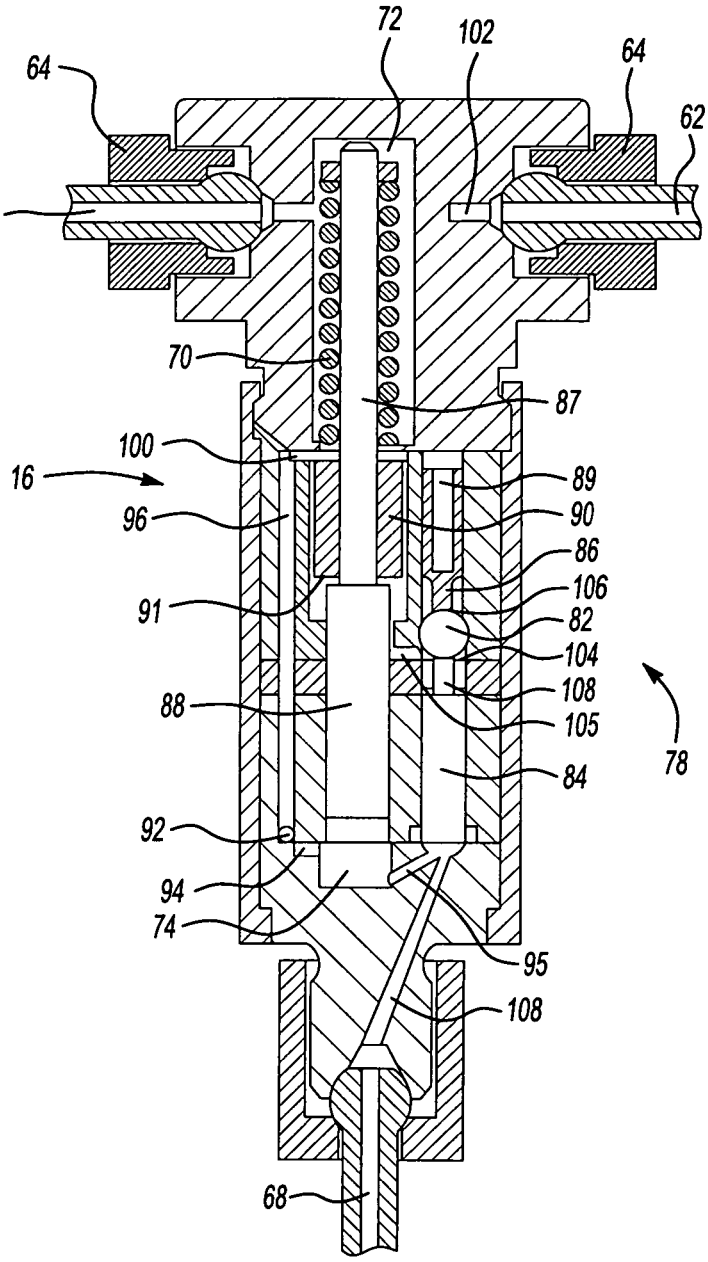
FIG. 3 is a cross-sectional view of an example fuel amplifier according to this invention.
Figure 4:
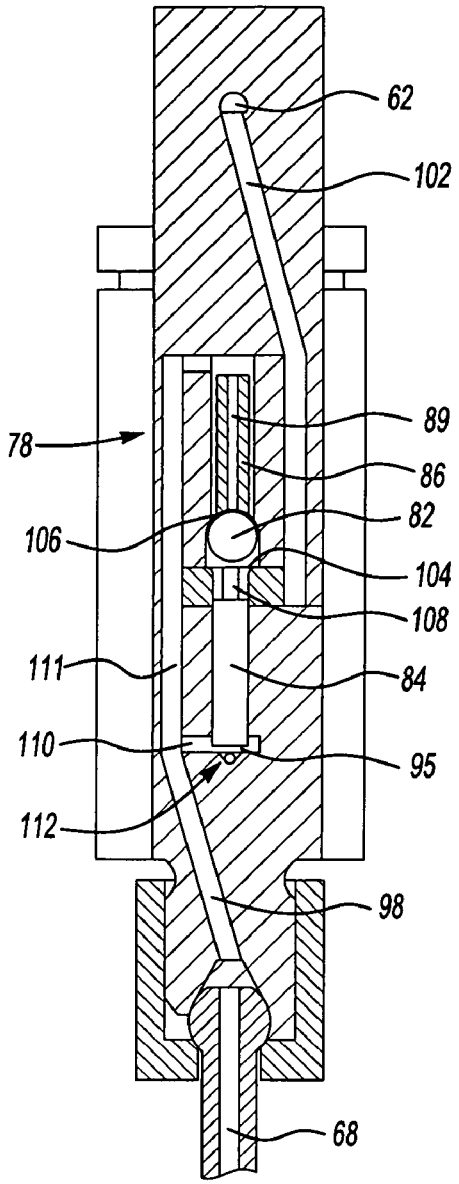
FIG. 4 is another cross-sectional view of the example fuel amplifier according to this invention.
Figure 5:
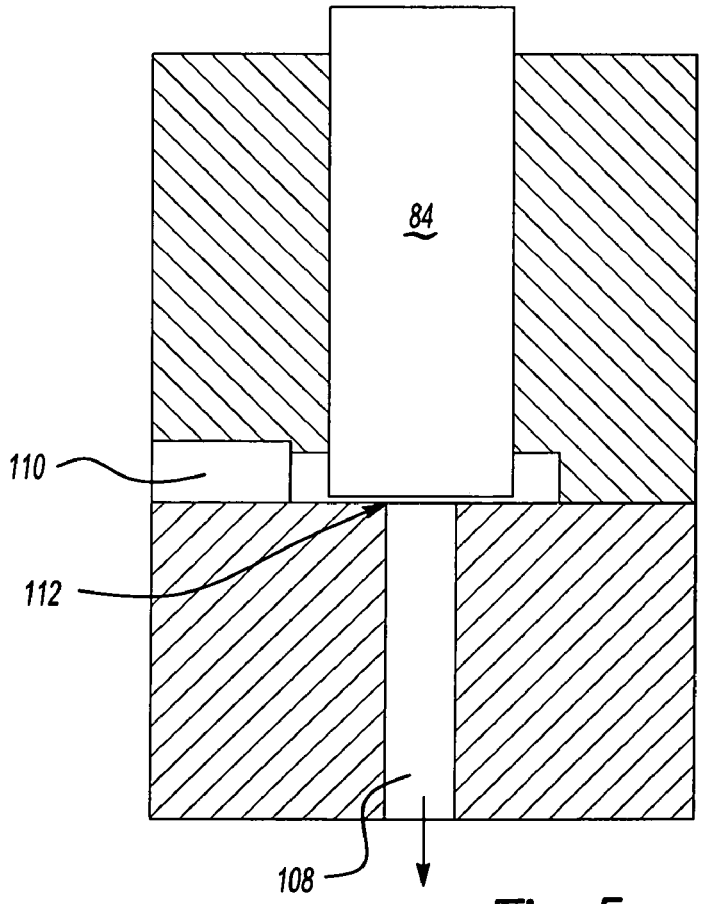
FIG. 5 is an enlarged cross-sectional view of a portion of the example fuel amplifier.

Referring to FIGS. 3, 4 and 5, the fuel amplifier 16 includes a fuel inlet 60. The fuel inlet 60 is held in place by a fitting 64. An exhaust outlet 62 is also held in place by another fitting 64. Fuel entering the fuel amplifier 16 proceeds through a series of bores and passages to an outlet 68 that leads to the corresponding fuel injector 14. The fuel pressure amplifier 16 increases fuel pressure that is provided at the first pressure from the fuel rail 12 to a second higher pressure that exits the outlet 68.

Fuel entering through the fuel inlet 60 is communicated to a spring bore 72. The spring bore 72 includes a biasing spring 70. The biasing spring 70 biases a plunger 88 towards a low-pressure position that is indicated in the example drawing as an upward most position. An intensifier piston 90 is disposed above the plunger 88 and about a rod 87 of the plunger 88 that extends upward into the spring bore 72. Fuel flow within the spring bore 72 flows through a passage 100 into a passage 96. The passage 96 includes a check ball 92 that allows fuel flow into a high-pressure chamber 74. From the high pressure chamber 74 fuel flows through a passage 95 to a valve assembly 78. The valve assembly 78 includes a valve ball 82 that is moved between an upper seat 106 and a lower seat 104 by a first piston 84 and a second piston 86.

The valve assembly 78 includes a passage 102 (FIG. 4) that is in communication with the exhaust outlet 62, and the exhaust outlet 62 is in communication with the return rail 26 that is at substantially ambient pressure, that is much less than the first fuel pressure from the fuel rail 12. Depending on the position of the valve ball 82, a bottom surface 91 of the intensifier piston 90 is selectively communicated with ambient pressure through the exhaust outlet 62. The selective communication of ambient pressure with the bottom surface of the intensifier piston 90 creates a pressure differential that drives the intensifier piston 90 and the plunger 88 downward into the high pressure chamber 74. The reduction of volume in the high pressure chamber 74 causes a corresponding increase in pressure that is communicated to the fuel injector 14.

In operation, fuel entering the inlet 60 flows through the spring bore 72 to the passage 100. From passage 100 fuel flows through the passage 96 past the check ball 92 into the high pressure chamber 74. From the high pressure chamber 74, fuel flows through a passage 95 and 110 (FIG. 5) past the first piston 84. The first piston 84 defines a flow gap 112 through which fuel flows to the passage 108 and out to the outlet 68.

The fuel flow through the flow gap 112 generates a desired pressure drop at the lower end of the first piston 84 such that pressure within the passage 108 and the outlet 68 is lower than fuel pressure within the passage 110. The lower pressure at the outlet 68 is communicated through another passage 98 and passage 111 to an area above the second piston 86. The reduced pressure above the second piston 86 creates a pressure differential between the first piston 84 and the second piston 86 that moves the first piston 84, the ball 82 and the second piston 86 upwardly such that the flow gap 112 is opened to reduce the restriction to fuel flow.

Seating of the valve ball 82 on the upper seat 106 opens a passage 105 that communicates ambient pressure to the bottom surface 91 of intensifier piston 90. The low ambient pressure at the bottom surface 91 of the intensifier piston 90 is overcome by the much greater fuel pressure communicated from the fuel rail 12, thereby driving the intensifier piston 90 downward. Downward movement of the intensifier piston 90 moves the plunger 88 downward into the high pressure chamber 74. The rapid decrease in volume of the high pressure chamber 74 caused by movement of the plunger 88 generates a desired increase in fuel pressure that is communicated through passages 110 and 98 and the outlet 68 to the fuel injector 14. The check ball 92 prevents back flow of high pressure fuel out the inlet 60.

Upon closing of the fuel injector 14, fuel flow through the fuel amplifier 16 stops and the pressure on the first and second pistons 84, 86 equalizes such that pressure exerted on each is the same. However, the second piston 86 includes a larger area exposed to the now equal pressure resulting in a force imbalance between the first piston 84 and the second piston 86. The force imbalance causes the valve ball 82 to move to the lower seat 104.

Movement of the valve ball 82 to the lower seat 104 end communication of ambient fuel pressure from the exhaust outlet 62 to the bottom surface 91 of the intensifier piston 90. Fuel pressure than equalizes between the top and bottom surface 91 of the intensifier piston 90 providing for the bias provided by the spring 70 to drive upward the intensifier piston 90 and the plunger 88. Fuel disposed between the intensifier piston 90 and the plunger 88 is exhausted to a cavity 89 within the second piston 86. The cycle is then repeated upon the next opening of the fuel injector 14 that commences the flow of fuel.

Figure 6:
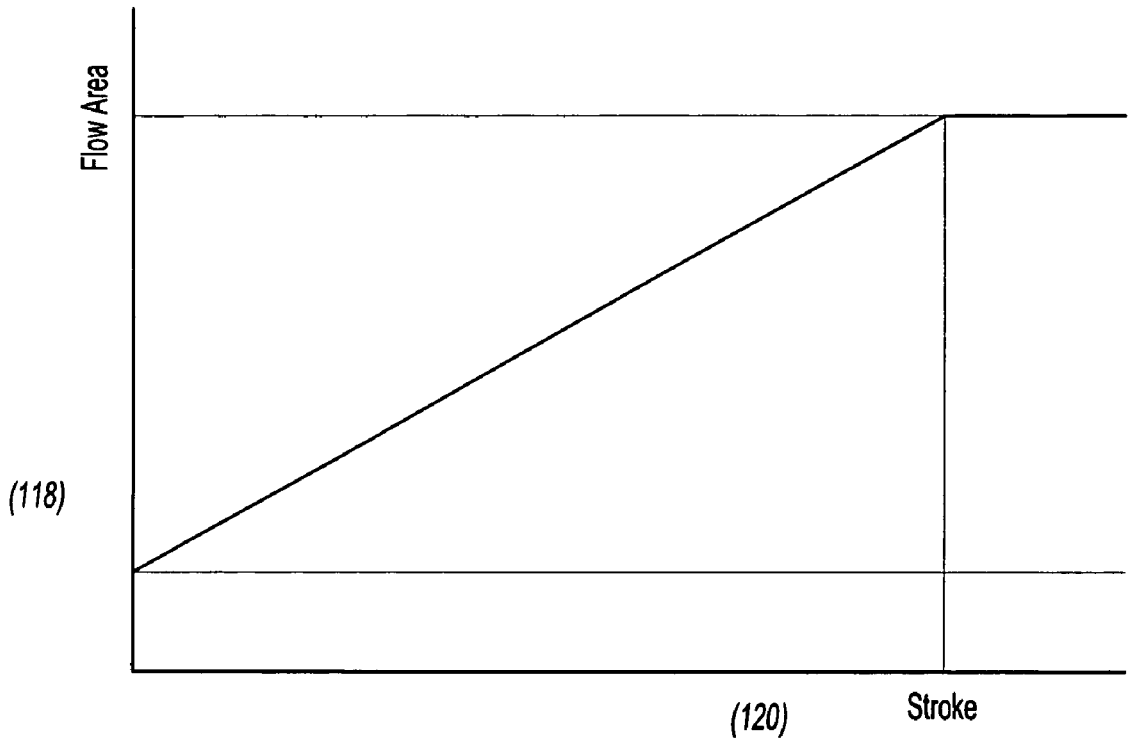
FIG. 6, is a graph illustrating an example relationship between fuel flow area and stroke according to this invention.

Referring to FIG. 6, a graph is illustrated that shows the stroke versus flow area relationship provided by the fuel amplifier 16. The area at which pressure acts on the intensifier piston is substantially twice that of the surface area on which the plunger 88 acts. Accordingly, the difference in area provides a corresponding increase in pressure. In the example case, a doubling of fuel pressure initially provided from the fuel rail 12.

As has been described in the example embodiment, the fuel amplifier 16 according to this invention provides an increase in fuel pressure downstream of the fuel rail 12 such that the fuel rail 12 and other upstream components need not be rated to accommodate the desired higher pressures. The fuel amplifier 16 provides the higher desired pressures directly to each fuel injector 14 responsive to fuel flow to provide the desired improvements to performance and efficiency.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel system comprising:

a fuel rail containing fuel at a first pressure;

a pressure amplifier that receives fuel from the fuel rail at the first pressure and increases the received fuel to a second pressure greater than the first pressure responsive to fuel flow therethrough; and at least one fuel injector receiving fuel at the second pressure from the pressure amplifier, the at least one fuel injector including an actuator for moving a needle valve for selectively blocking an outlet of the fuel injector, wherein the pressure amplifier receives fuel from the fuel rail responsive to the needle valve being moved by the actuator to a position not blocking the outlet.

2. The system as recited in claim 1, wherein the pressure amplifier includes a high pressure chamber including a high pressure plunger driven by an intensifier piston selectively controlled by a valve, wherein the high pressure plunger is driven into the high pressure chamber to increase fuel pressure to the second pressure.

3. The system as recited in claim 2, wherein the valve selectively communicates ambient pressure to generate a pressure differential across the intensifier piston that drives the high pressure plunger into the high pressure chamber.

4. The system as recited in claim 3, wherein the valve is movable responsive to fuel flow through the pressure amplifier.

5. The system as recited in claim 4, wherein the valve comprises a ball movable between an upper seat and a lower seat responsive to fuel flow through the fuel amplifier.

6. The system as recited in claim 4, including a check valve in communication with the high-pressure chamber for selectively communicating fuel between the high-pressure chamber and the fuel rail.

7. The system as recited in claim 6, wherein the high-pressure chamber is in communication with the fuel injector.

8. The system as recited in claim 7, including a biasing member biasing the high-pressure plunger toward a position out of the high pressure chamber.

9. The system as recited in claim 1, wherein the at least one fuel injector comprises a plurality of fuel injectors and a corresponding plurality of pressure amplifiers.

10. A fuel amplifier assembly for a fuel system comprising:

a housing defining a fuel inlet, a fuel outlet and an exhaust;

a high pressure plunger movable within a high pressure chamber; and a valve movable responsive to fuel flow out through the fuel outlet for driving the high pressure plunger into the high pressure chamber to increase fuel pressure communicated to a fuel injector.

11. The assembly as recited in claim 10, including an intensifier piston for driving the high pressure plunger into the high pressure chamber, wherein the valve selectively communicates ambient pressure with the intensifier piston for generating a pressure differential driving the high pressure plunger into the pressure chamber.

12. The assembly as recited in claim 11, wherein the valve comprises a ball movable between an upper seat and a lower seat responsive to fuel flow through the fuel amplifier.

13. The assembly as recited in claim 12, including a check valve in communication with the high-pressure chamber for selectively communicating fuel between the high-pressure chamber and a fuel source.

14. The assembly as recited in claim 10, including a biasing member biasing the high-pressure plunger toward a position out of the high pressure chamber.

15. The assembly as recited in claim 14, wherein the high-pressure chamber is in communication with the fuel injector.

16. A fuel system comprising:

a fuel rail containing fuel at a first pressure;

a pressure amplifier that receives fuel from the fuel rail at the first pressure and increases the received fuel to a second pressure greater than the first pressure responsive to fuel flow therethrough, the pressure amplifier including a high pressure chamber, a high pressure plunger driven into the high pressure chamber to increase fuel pressure to the second pressure by an intensifier piston selectively controlled by a valve, wherein the valve is movable responsive to fuel flow through an outlet of the pressure amplifier; and at least one fuel injector receiving fuel at the second pressure from the pressure amplifier.

17. The fuel system as recited in claim 16, wherein the fuel injector includes an actuator moving a needle valve for selectively blocking a fuel outlet, wherein flow through the pressure amplifier outlet occurs responsive to the needle valve being moved to a position not blocking the fuel outlet of the fuel injector.

18. The fuel system as recited in claim 16, wherein the valve selectively communicates ambient pressure across the intensifier piston to generate a pressure differential that drives the high pressure plunger into the high pressure chamber.

* * * * *